United States Patent [19]

Pitozzi

[11] Patent Number: 4,512,305

[45] Date of Patent: Apr. 23, 1985

[54] DELIVERY-REGULATION UNIT FOR IN-LINE INJECTION PUMPS

[75] Inventor: Luigi Pitozzi, Brescia, Italy

[73] Assignee: SAME S.p.A., Treviglio, Italy

[21] Appl. No.: 539,946

[22] Filed: Oct. 7, 1983

[30] Foreign Application Priority Data

Oct. 11, 1982 [IT] Italy ..... 23142/82[U]

[51] Int. Cl.[3] ..... F02D 31/00

[52] U.S. Cl. ..... 123/364; 123/372

[58] Field of Search ..... 123/364–374

[56] References Cited

U.S. PATENT DOCUMENTS

| | | | |
|---|---|---|---|
| 2,793,630 | 5/1957 | Halik | 123/364 |
| 3,667,437 | 6/1972 | Dreisin | 123/372 |

FOREIGN PATENT DOCUMENTS

| | | | |
|---|---|---|---|
| 589111 | 2/1931 | Fed. Rep. of Germany | 123/364 |
| 83527 | 7/1981 | Japan | 123/364 |
| 548457 | 10/1942 | United Kingdom | 123/364 |
| 549210 | 11/1942 | United Kingdom | 123/364 |
| 2038934 | 7/1980 | United Kingdom | 123/364 |

*Primary Examiner*—Magdalen Y. C. Moy

*Attorney, Agent, or Firm*—Stevens, Davis, Miller & Mosher

[57] ABSTRACT

For concurrently regulating the delivery of fuel-injection pumps of polycylindrical Diesel engines, a rod slidably supported by antifriction means is operatively connected to the individual pump governors. The supporting members are mounted with the aid of centering rings which coact with flanges secured to the engine block by screws.

The problem of the simultaneous control of a number of injection pumps is thus solved both simply and cheaply.

2 Claims, 1 Drawing Figure

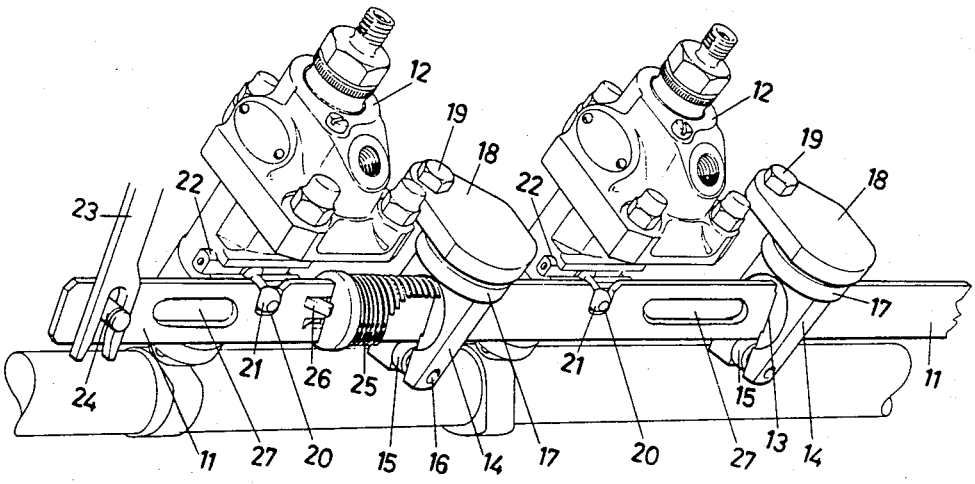
12
19
18
22
23
24
21
26
25
11
27
20
15
16
14
17
12
19
18
22
21
20
27
15
13
14
17
11

DELIVERY-REGULATION UNIT FOR IN-LINE INJECTION PUMPS

It is known to all those who are skilled in the art that, in a reciprocating polycylindrical Diesel engine in which the fuel is injected by individual pumps, but into each individual cylinder, there is the problem as to how to control such pumps concurrently. The pump-controlling device, moreover, must have a minimum inertia and minimum internal friction in order that it may work quite satisfactorily, especially as far as the synchronization of the motions is concerned.

An objective of the present invention is to solve such problems and to fulfil such technical requirements in the most easy and cheap way.

To this purpose, according to the invention, it has been envisaged to provide a delivery-regulation units for in-line injection pumps which are embedded in the engine bed, more particularly for polycylindrical Diesel engines, characterized in that it comprises a rod, slidably supported by antifriction means and operatively connected to the pump-regulation members.

The structural and functional features of the present invention will become clearly apparent from the diagrammatical accompanying drawing which shows a perspective view of a detail of a control unit made according to this invention.

Having now reference to the drawing, the control unit according to the invention, consists of a slidable control rod 11 for the individual pumps 12 which are embedded in the engine bedplate (not shown).

The rod 11, for example of stamped steel sheet, can slide within guiding slots 13 which are formed within supporting members 14 and are arranged vertically, and rests upon followers 15 idly running about pins 16, these latter being secured to said supporting members 14.

The supporting members 14 are mounted by centering rings 17 which coact with flanges 18: these are secured to the cylinder block (not shown) by screws 19 which are intended to additionally adjust the positions of said supporting members.

The rod 11, furthermore, carried mutually spaced apart hollow spaces 20 which are properly arranged in registry with dowels 21 which latter serve for controlling a rack 22 intended to regulate the individual pumps 12, such dowels being integral with said racks.

The rod 11 is caused to be shifted by the lever 23 of the governor which in its end forked-out portion engages the dowel 24 secured to said rod 11. A biassing spring 25 is likewise provided and has the task of taking up the clearances of the regulation linkage. To this purpose, the spring 25 is active between either supporting member 14 and spread apart crenellations, 26, appropriately formed in the rod 11.

The springs 25 can be mounted just as shown in the drawing, that is to say, to bring back the rod 11 to the position of no-delivery against the bias of the other regulation springs, or, as an alternative, in the opposite direction to shift the rod to the maximum-delivery position against the counteracting force as provided by the masses of the governor.

In the first case, it contributes towards the reliability of the system, whereas, in the second case, the automatic supplement action is simplified.

During progress of the assembling and adjusting operations, the several supporting member 14 are aligned by introducing a tool which simulates the rod 11 and controlling that the rod-simulator smoothly slides within the slots 13, whereupon the screws 19 are tightened.

This operation ensures alignment without requiring expensive machining of the cylinder blocks.

It should be taken into account, moreover, that, as soon as the device has been assembled, it is still possible to act upon the regulation of the individual pumps by rotating them about their own axes and without acting upon their support members, the latter being quite independent.

To diminish and to minimize its inertia, the rod can also be lightened by forming openings 27 therethrough, whereas, in order to reduce the friction further and to minimize cost, the supporting members can be made of aluminium molten under pressure or sintered steel.

I claim:

1. A delivery-regulation unit for in-line injection pumps arranged with parallel axes in an engine bed, particularly for multi-cylinder Diesel engines, comprising a reciprocating rod arranged adjacent to individual injection pumps, and pump governor means for each of said injection pumps, said pump governor means each comprising a rack slidably supported by the respective injection pump outside thereof and substantially tangentially thereto for controlling fuel injection thereof, wherein said rod has slots adjacent to the injection pumps and each rack is connected to a respective one of said slots by a swivel joint means to allow adjustment of said pumps individually by angular displacement thereof about their axes.

2. A delivery-regulation unit as claimed in claim 1 further comprising forked-out supporting members for guiding said rod, idlers rotatably supported by pins secured to said supporting members, and centering rings above said supporting members for holding said supporting members in alignment for slidingly receiving said rod on said idlers.

* * * * *